US006848596B2

(12) United States Patent
Balz et al.

(10) Patent No.: US 6,848,596 B2
(45) Date of Patent: Feb. 1, 2005

(54) UPRIGHT PRODUCT OUTLET BAG EVACUATION PACKAGING

(75) Inventors: Eric R. Balz, Stillwater, MN (US); Thomas P. Berg, Woodbury, MN (US); John E. Thomas, River Falls, WI (US)

(73) Assignee: Ecolab Inc., St. Paul, MN (US)

( * ) Notice: Subject to any disclaimer, the term of this patent is extended or adjusted under 35 U.S.C. 154(b) by 179 days.

(21) Appl. No.: 10/279,202

(22) Filed: Oct. 23, 2002

(65) Prior Publication Data

US 2004/0079764 A1 Apr. 29, 2004

(51) Int. Cl.[7] ..... B65D 35/56
(52) U.S. Cl. ..... 222/1; 222/105
(58) Field of Search ..... 222/1, 92, 105; 220/495.01; 229/117.29

(56) References Cited

U.S. PATENT DOCUMENTS

| | | | | |
|---|---|---|---|---|
| 3,940,018 | A | 2/1976 | Scholle | |
| 4,342,314 | A | 8/1982 | Radel et al. | 128/287 |
| 4,695,422 | A | 9/1987 | Curro et al. | 264/504 |
| 4,756,422 | A | 7/1988 | Kristen | 206/524.8 |
| 5,156,299 | A | 10/1992 | De Caluwe et al. | 222/82 |
| RE34,929 | E | 5/1995 | Kristen | 206/524.8 |
| 5,647,511 | A | 7/1997 | Bond | 222/105 |
| 5,749,493 | A | 5/1998 | Boone et al. | 222/105 |
| 5,915,596 | A | 6/1999 | Credle, Jr. | 222/105 |
| 5,941,421 | A | 8/1999 | Overman et al. | 222/105 |
| 6,045,006 | A | 4/2000 | Frazier et al. | 222/105 |
| 6,073,807 | A | 6/2000 | Wilford et al. | 222/105 |
| 6,102,252 | A | 8/2000 | Overman et al. | 222/105 |
| 6,179,173 | B1 | 1/2001 | Frazier et al. | 222/573 |
| 6,667,081 | B1 * | 12/2003 | Aoki et al. | 428/34.1 |
| 2001/0046545 | A1 | 11/2001 | Jones | |
| 2002/0121527 | A1 * | 9/2002 | Good | 222/94 |
| 2002/0148857 | A1 * | 10/2002 | Savage et al. | 222/107 |

FOREIGN PATENT DOCUMENTS

| | | |
|---|---|---|
| DE | 39 25 871 A1 | 2/1991 |
| EP | 0 613 833 A1 | 9/1994 |
| EP | 0 997 391 A1 | 5/2000 |

* cited by examiner

*Primary Examiner*—Gene Mancene
*Assistant Examiner*—Patrick Buechner
(74) *Attorney, Agent, or Firm*—IPLM Group, P.A.

(57) ABSTRACT

An upright product outlet bag evacuation packaging (100, 200) includes a flexible, collapsible bag (101, 201) and a spout (116, 216) that contains and dispenses a liquid (118, 218). The bag (101, 201) includes a first wall (102, 202) and a second wall (104, 204) that are operatively connected by a seam (106, 206). When the bag (101, 201) is filled with liquid (118, 218), the first wall (102, 202) and the second wall (104, 204) are pushed away from one another thereby pulling a first side (109, 209) inward and causing an indentation (114, 214) to form. The indentation (114, 214) hinders flush contact between the first wall (102, 202) and the second wall (104, 204) as the bag (101, 201) progressively collapses as the liquid (118, 218) is dispensed. A housing (300, 400) for use with a dispenser may be used to create and reinforce the indentation (114, 214). The housing (300, 400) includes a cavity (303, 403) configured and arranged to receive the bag (101, 201). A door (302, 402) is operatively connected to the housing and includes a bar member (304, 404) which extends into the cavity (303, 304). The bar member (304, 404) contacts the bag (101, 201) with the cavity (303, 304) to create and reinforce the indentation (114, 214).

24 Claims, 16 Drawing Sheets

FIG. 5
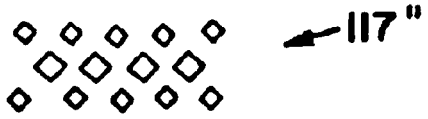
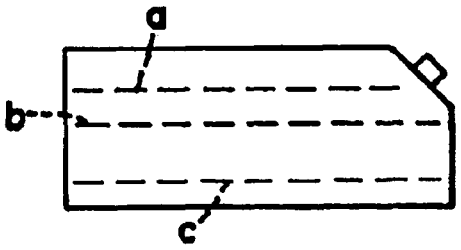
FIG. 6
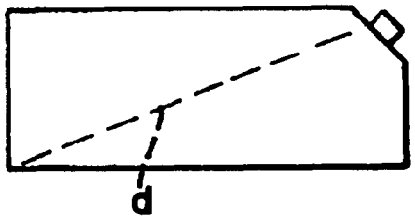
FIG. 7

UPRIGHT PRODUCT OUTLET BAG EVACUATION PACKAGING

BACKGROUND OF THE INVENTION

1. Field of the Invention

The present invention relates to an upright product outlet bag evacuation packaging.

2. Description of the Prior Art

Packaging for containing and dispensing liquids such as syrup for post-mix beverage dispensers is known in the art. Such packaging typically includes a flexible, collapsible plastic bag containing the liquid. The plastic bag typically has a spout for supplying the liquid to the dispenser via a hose and a pump. Preferably, the spout is located above the liquid fill line proximate the top of the bag to reduce the likelihood of leakage from the spout. A plastic dip strip or dip tube is often included within the bag proximate the spout to assist in withdrawing substantially all of the liquid from the bag. The dip strip or dip tube provides a channel through which the liquid travels while being dispensed. The dip strip or dip tube also prevents the walls of the bag from collapsing upon one another, which would block the flow of the liquid from the bag. The addition of the dip strip or dip tube to the bag increases the cost of manufacturing the packaging. An example of such a dip strip is shown in U.S. Pat. No. 6,045,006 to Frazier et al.

SUMMARY OF THE INVENTION

In a preferred embodiment disposable liquid containing and dispensing package, a flexible bag includes a first wall, a second wall, and a cavity. The first wall and the second wall are operatively connected thereby creating a seam and creating the cavity therein. The bag includes a top, a bottom, a first side, and a second side. An opening in the bag proximate the top and the first side of the bag allows access to the cavity, and a spout is operatively connected to the opening. A liquid is contained within the cavity. An indentation in the seam on the first side of the bag is formed when the bag is positioned along the seam on the bottom. The indentation hinders flush contact between the first wall and the second wall as the bag progressively collapses as the liquid is dispensed.

In a preferred embodiment method of dispensing a liquid from a collapsible, disposable bag within a dispenser housing, the bag is made of 0.004 to 0.007 inch film and includes a first wall and a second wall. The first wall and the second wall are sealed along a seam, and the seam is approximately 5 to 10 mm wide. The bag includes a top, a bottom, a first side, and a second side, and the seam forms a cavity and includes an opening proximate the top and the first side of the bag. A spout is operatively connected within the opening to provide access to the cavity, and approximately two liters of liquid are contained within the cavity, wherein a liquid containment area of the bag has a middle portion with a width of approximately 4 to 6 inches and a length to height ratio of approximately 1:1 to 3:1. A bag filled with liquid is placed in a dispenser housing on a bottom seam of the bag. A first indentation is formed in a seam on a first side of the bag, the indentation extending from the first wall to the second wall. The liquid is dispensed from the bag, wherein the first indentation hinders flush contact between the first wall and the second wall as the bag progressively collapses as the liquid is dispensed.

In a preferred embodiment method of dispensing a liquid from a bag, a first wall and a second wall made of 0.004 to 0.007 inch film are provided. A textured surface is created on at least one of the walls. The first wall and the second wall are sealed together thereby forming a bag with a cavity and an opening. The bag has a top, a bottom, a first side, and a second side. The opening is proximate the top and the first side allowing access to the cavity. The textured surface extends from proximate the second side to proximate the opening. A spout is provided and operatively connected within the opening of the bag. The cavity of the bag is filled with a liquid. The bag filled with liquid has a liquid containment area with a length to height ratio of approximately 1:1 to 3:1. The bag filled with the liquid is placed in a dispenser housing on the bottom of the bag. An indentation on the first side of the bag is created, and the liquid is dispensed from the spout, wherein the indentation and the plurality of protrusions hinder flush contact between the first wall and the second wall as the bag progressively collapses.

In a preferred embodiment dispensing system, a housing for use with a product dispenser includes a compartment and a door. The compartment has a first cavity and an opening allowing access to the first cavity. The door is configured and arranged to cover the opening and has an inner surface. A flexible bag includes a first wall, a second wall, and a second cavity. The first wall and the second wall are operatively connected thereby creating a seam and creating the second cavity therein. The bag includes a top, a bottom, a first side, and a second side. The bag includes an opening proximate the top and the first side of the bag, and the opening allows access to the second cavity. A spout is operatively connected to the opening. A liquid is contained within the second cavity. An indentation in the seam on the first side of the bag is formed when the bag is positioned along the seam on the bottom. The indentation hinders flush contact between the first wall and the second wall as the bag progressively collapses as the liquid is dispensed. A bar member is operatively connected to and extends from the inner surface of the door, and the bar member creates and reinforces the indentation in the bag when the bag is placed within the first cavity.

In a preferred embodiment disposable liquid containing and dispensing package, a flexible bag includes a first wall, a second wall, and a cavity. The first wall and the second wall are operatively connected thereby creating a seam and creating the cavity therein. The bag includes a top, a bottom, a first side, and a second side. An opening in the bag proximate the top and the first side of the bag allows access to the cavity, and a spout is operatively connected to the opening. A liquid is contained within the cavity. An indentation on the first side of the bag is a sufficiently rigid horizontal member extending from the first wall and the second wall to keep the walls spaced apart from each other. The indentation is formed when the bag is positioned along the bottom, and the indentation hinders flush contact between the first wall and the second wall as the bag progressively collapses as the liquid is dispensed.

BRIEF DESCRIPTION OF THE DRAWINGS

FIG. 5 is a schematic of another arrangement of a plurality of embossed protrusions;

FIGS. 6 and 7 show possible arrangements of the plurality of embossed protrusions on the package shown in FIG. 2;

DETAILED DESCRIPTION OF THE PREFERRED EMBODIMENT

Figure 1:
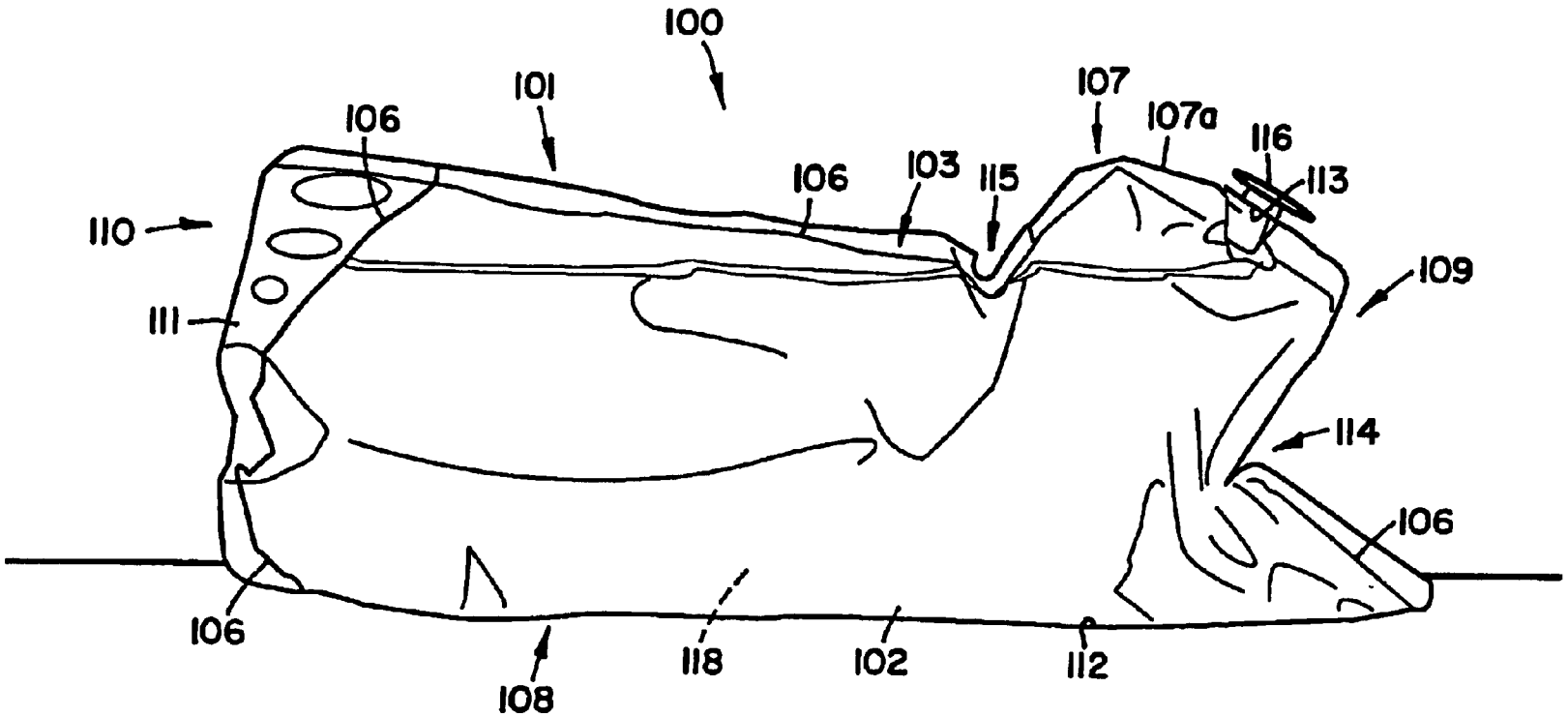
FIG. 1 is a side view of a disposable liquid containing and dispensing package constructed according to the principles of the present invention.

A disposable liquid containing and dispensing package constructed according to the principles of the present invention is designated by the numerals 100 and 200.

In one embodiment, the disposable liquid containing and dispensing package 100 includes a flexible, collapsible bag 101 and a spout or fitment 116. The bag 101 has a first wall 102 with a perimeter 103 and a second wall 104 with a perimeter 105. The perimeters 103 and 105 are similarly sized and configured, and the first wall 102 and the second wall 104 are operatively connected by seam 106 proximate the perimeters 103 and 105 thereby forming bag 101. However, it is recognized that the walls 102 and 104 may be connected in various locations not limited to proximate the perimeter by any suitable means well known in the art. When the bag 101 is empty and flattened, the first wall 102 and the second wall 104 are parallel. In the preferred embodiment, the seam 106 is heat sealed to form the bag 101 with a cavity 112 formed therein. A liquid 118 is contained within the cavity 112.

The bag 101 is preferably generally rectangular in shape, and when placed in a horizontal orientation (as shown in FIG. 1) the seam 106 defines a top 107, a bottom 108, a first side 109, and a second side 110. The preferred embodiment bag 101 has dimensions of approximately 6 inches high by 15 inches long. In the preferred embodiment, an angled portion 107*a* interconnects the top 107 and the first side 109, and an opening 113 is located within the angled portion 107*a* proximate the juncture of the top 107 and the first side 109. The angled portion 107*a* is preferably at an angle of 15–75° from the first side 109, and the preferred embodiment utilizes an angle of approximately 45°.

Figure 2:
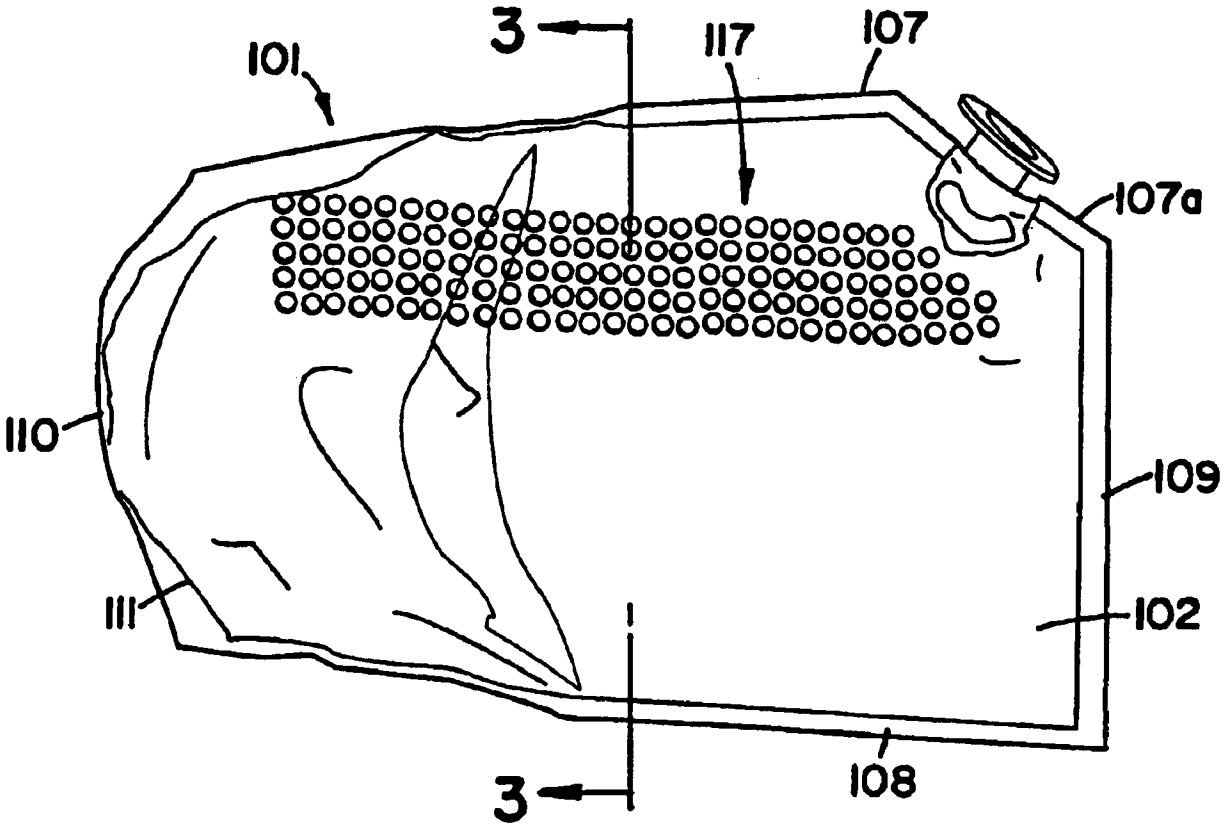
FIG. 2 is a side view of another embodiment disposable liquid containing and dispensing package with a plurality of embossed protrusions constructed according to the principles of the present invention.

The spout 116 is operatively connected within the opening 113 to the bag 101, and the opening 113 allows access into the cavity 112. Although the spout 116 is shown proximate the center of the angled portion 107*a*, the spout 116 may be located anywhere along the angled portion 107*a* as long as there is approximately 10 mm from the end on either side of the angled portion 107*a* to accommodate the seam 106. In the preferred embodiment, the bag 101 includes a canoe style outlet spout 116 such as CLEAN CLIC SYSTEM™ by Innovative Packaging Network (Itsac N.V.), which is disclosed in U.S. Pat. No. 6,126,045, incorporated by referenced herein. Although the opening 113 and the spout 116 may be positioned and oriented in numerous arrangements on the bag 101 proximate the first indentation 114, it is preferred that they be within the angled portion 107*a* proximate the juncture of the top 107 and the first side 109 of the bag 101 as shown in FIG. 2.

Figure 3:
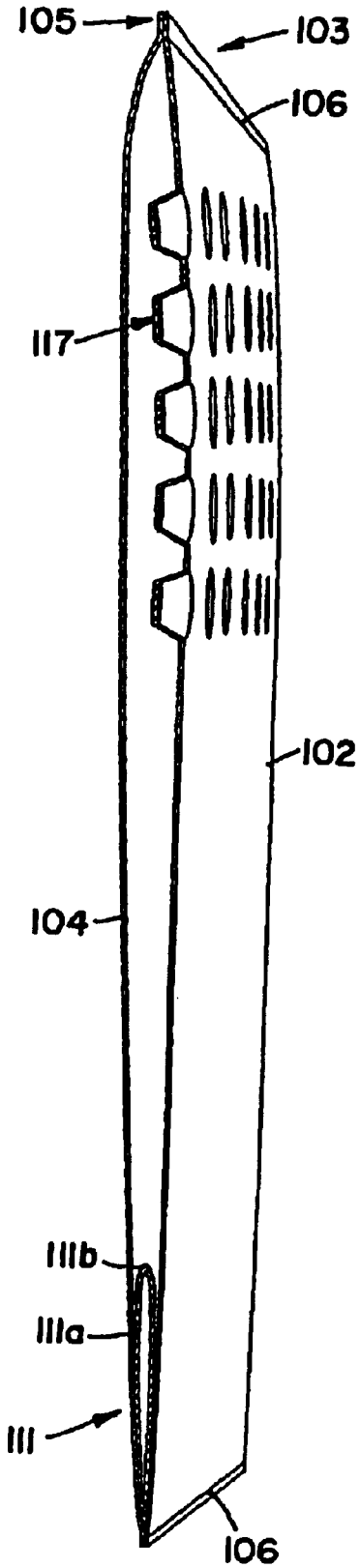
FIG. 3 is a cross-sectional perspective view of the package taken along the lines 3—3 shown in FIG. 2.
Figure 4:
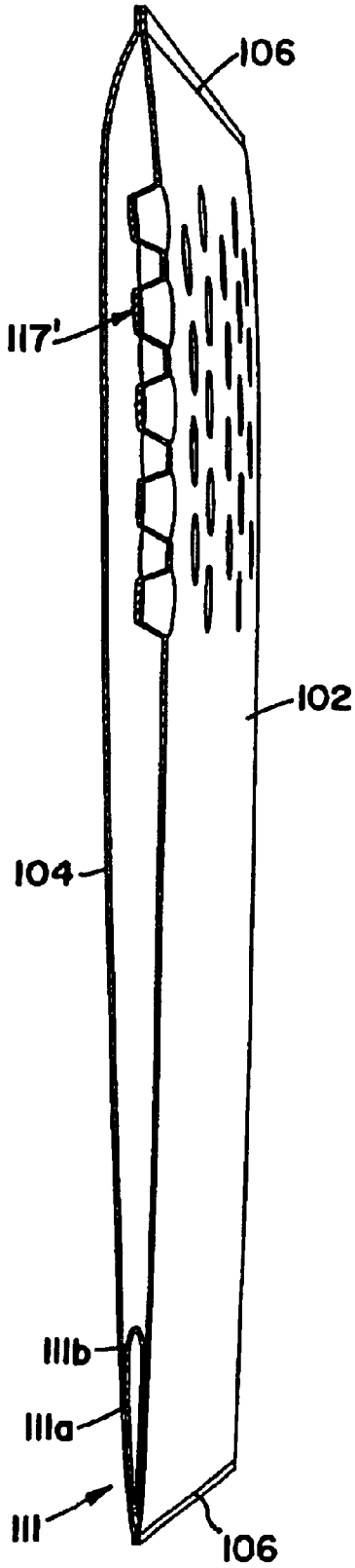
FIG. 4 is a cross-sectional perspective view of another embodiment package having another arrangement of a plurality of embossed protrusions.

The second side 110 may include a stabilizing member 111, which provides support for the bag 101 when placed in a vertical orientation for storage purposes. In the preferred embodiment, the stabilizing member 111 is a gusseted portion of the bag 101. To create the gusseted portion, a third sheet 111*a* is folded in half to form a fold 111*b* and placed between the first wall 102 and the second wall 104 proximate the second side 110. This is shown in FIGS. 3 and 4. Along the second side 110, a first end of the third sheet 111*a* is connected to the first wall 102 and a second end of the third sheet 111*a* is connected to the second wall 104 by seam 106. In other words, the bag 101 is bifurcated from the fold 111*b* to the perimeter 103 of the second side 110. The sides of the third sheet 111*a* are connected to both the first wall 102 and the second wall 104. In other words, the top 107 and the bottom 108 have four layers along the third sheet 111*a*. As shown in FIGS. 1 and 2, the seam 106 also cuts generally diagonally proximate the juncture of the top 107 and the second side 110 and the juncture of the bottom 108 and the second side 110. When the bag 101 is filled with liquid 118 and placed on its second side 110, the liquid 118 pushes the first and second walls 102 and 104 apart thereby opening the third sheet 111*a* and providing a surface upon which the bag 101 may be supported.

The bag 101 is configured and arranged to contain and dispense a liquid 118, which is contained within the cavity 112. When the bag 101 is filled with liquid 118, the width of the center portion of the bag 101 is approximately 4 to 6 inches. As shown in FIG. 1, when the bag 101 contains a liquid 118, a first indentation 114 resembling a V-shape is formed in the seam 106 of the first side 109 when the bag 101 is positioned along the seam 106 on the bottom 108. In the preferred embodiment, the first indentation 114 protrudes approximately 1 to 3 inches into the bag 101. When the bag 101 is placed on its bottom 108, the liquid 118 pushes the walls 102 and 104 outward away from one another and from the seam 106. The force of the liquid 118 against the walls 102 and 104 causes the seam 106 proximate the first side 109 to flatten and bend inward thereby causing the first side 109 to pull inward at the bend in the seam 106, which creates the first indentation 114. The first indentation 114 hinders flush contact between the first wall 102 and the second wall 104 as the bag 101 progressively collapses as the liquid 118 is dispensed.

A second indentation 115, which is optional, may also be formed in the seam 106 of the top 107 of the bag 101. The second indentation 115 is also formed by the liquid 118 pushing the walls 102 and 104 outward away from the seam 106 thereby causing the top 107 to pull inward. The second indentation 115 also hinders flush contact between the first wall 102 and the second wall 104 as the bag 101 progressively collapses as the liquid 118 is dispensed.

The first indentation 114 and the second indentation 115 are sufficiently rigid horizontal members extending from the first wall 102 and the second wall 104 to keep the walls spaced apart from each other while the package is being emptied. The sufficiently rigid horizontal members may be creases or pleats formed in the walls to keep the walls apart from one another. The geometry, the film thickness, and the seam of the bag along with the liquid contained within the bag assist in keeping the creases or pleats in the walls. Alternatively, reinforced portions or heat sealed portions extending from the first wall 102 and the second wall 104 proximate the angled portion 107*a* may be included to assist in keeping the first and second walls apart from one another. The reinforced portions or heat sealed portions may be included proximate the first side 109 and optionally proximate the top 107 as well.

In addition, the bag 101 may include a plurality of embossed protrusions 117 formed on at least one wall of the bag 101, as shown in FIGS. 2 and 3. The plurality of embossed protrusions 117 on at least one wall extends from proximate the second side 110 to proximate the spout 116 and the first side 109. The plurality of embossed protrusions 117 also hinder flush contact between the first wall 102 and the second wall 104 as the bag 101 progressively collapses as the liquid 118 is dispensed. The plurality of embossed protrusions 117 may be in any shape and in any arrangement on the bag wall. The embossed protrusions 117 may be round, diamond-shaped, or any other shape, and they may be aligned or staggered as long as they prevent flush contact between the two walls of the bag. FIG. 4 shows a cross-sectional view of another embodiment having another possible arrangement of plurality of embossed protrusions 117' and FIG. 5 shows a schematic view of another possible pattern of the plurality of embossed protrusions 117" on the bag wall 102. The texture on at least one wall creates an amount of space between the two walls so the two walls do not fully adhere to one another thereby sealing off the bag and preventing the flow of product out of the bag. FIGS. 6 and 7 show possible arrangements of the plurality of protrusions on the bag wall. Generally, the dashed lines "a" show the plurality of embossed protrusions proximate the top of the bag, lines "b" are proximate the middle of the bag, lines "c" are proximate the bottom of the bag, and lines "d" are diagonal from the bottom to the top of the bag. It is recognized, however, that any suitable arrangement will suffice as long as the arrangement facilitates the dispensing of the liquid 118 from the bag 101.

The preferred embodiment bag 101 is a flexible two-liter, gusseted, stand-up bag with an integrated spout or fitment 116. Again, the preferred embodiment bag 101 has dimensions of approximately 6 inches high by 15 inches long. In addition, the film thickness of the bag 101 is approximately 0.004 to 0.007 inches. Although a two-liter bag is preferred, it is recognized that other suitable sizes are acceptable as long as the ratio of the length to the height with regard to the width of the bag are proportionately consistent with those disclosed herein. To dispense the product, the bag 101 is utilized in a horizontal orientation with the fitment 116 angled upward and located above the product fill level. To overcome the risk of product leakage, it is desirable for the product outlet 116 to be located above the product fill level. The bag 101 may be stored in a vertical orientation because the second side 110 includes a stabilizing member 111 that provides for a stable vertical orientation.

Without a secondary device such as a dip strip or a dip tube being added to the bag 101, manufacture of the bag is simplified because the plurality of embossed protrusions 117 are created on at least one wall during manufacture of the wall. In addition, the shape of the bag 101 and the location of the seam 106 along the top 107, bottom 108, and sides 109 and 110 allow formation of the indentations 114 and 115 when the bag 101 contains product. Therefore, secondary devices are not necessary to ensure most of the product is dispensed from the bag 101.

Again, dispensing of the liquid 118 is facilitated in two ways. First, the bag 101 is placed on seam 106 along the bottom 108 and a V-shaped indentation 114 is formed in the first side 109. An indentation 115 may optionally also be formed on the top 107. If the bag 101 is placed in a vertical orientation rather than a horizontal orientation, then only about 40% to 60% of the product will dispense from the bag 101.

The present invention allows the product 118 to be dispensed from the packaging 100 when the product outlet 116 is above the product fill level while achieving maximum evacuation and adequate flow rates of the product 118. In the preferred embodiment, placing the bag 101 on its bottom 108 along the seam 106 opposite the fitment 116 allows for the product 118 to be substantially dispensed. In this orientation, the walls 102 and 104 of the bag 101 are forced away from each other and do not seal against each other. In addition, the "V-shape" indentation 114 formed on the first side 109 of the bag 101 assists in keeping the walls 102 and 104 of the bag 101 away from one another thereby preventing the walls 102 and 104 from sealing around the product outlet 116. Also, the seam 106 along the top 107 of the bag 101 assists in creating a channel along which the product 118 may follow as it is dispensed. Other orientations may not be as effective due to the walls 102 and 104 of the bag 101 collapsing upon one another thereby preventing flow of the product 118 and causing a significant amount of product 118 to remain in the bag 101.

In addition to the product bag 101 configuration and orientation, a patterned embossment 117 in at least one of the bag walls may be used to provide an evacuation path for product 118 to follow as the bag 101 collapses and product 118 is dispensed. The protrusions of the patterned embossment 117 prevent the walls 102 and 104 from fully contacting one another thereby sealing the bag 101. In other words, the spaces between the protrusions provide passageways through which the product 118 may travel to the spout or fitment 116.

In operation, the bag 101 filled with liquid 118 is placed in a dispenser (not shown) on the seam 106 along the bottom 108 of the bag 101, and the spout 116 is located proximate the top of the bag 101 within the angled portion 107*a*. The first indentation 114 is formed in the seam 106 on the first side 109 of the bag 101, and the optional second indentation may be formed on the top 107 of the bag 101. As the liquid 118 is dispensed from the bag 101, the first indentation 114 and the second indentation 115 hinder flush contact between the first wall 102 and the second wall 104 proximate the spout 116 as the bag progressively collapses. In addition, a textured surface may be created on at least one of the bag walls to hinder flush contact between the first wall 102 and the second wall 104 as the bag 101 progressively collapses as the liquid 118 is dispensed. Therefore, the liquid 118 is more completely dispensed because the bag walls do not come into flush contact with one another thereby blocking the flow of the liquid 118 out of the bag 101.

EXAMPLE

Evacuation testing of the product flow rate and the percentage of residual product was performed using two product bags (bags 101). One bag was placed in the top opening and one bag was placed in the bottom opening of a four station product cabinet. The cycle sequence used for the test was 12 seconds on and 150 seconds off for a 1 gpm aspirator and 24 seconds on and 150 seconds off for a 4 gpm aspirator. The normal cabinet orientation was with the bags in a horizontal position, and abnormal cabinet orientation was to raise the fitment side so the cabinet was angled 10 degrees. The correct bag orientation was with the side seam opposite the fitment in a downward position, the incorrect bag orientation was with the side seam opposite the fitment in an upward position. A thick product, Oasis Lemon Tub and Tile, was used. Normal water pressure was 40 psi and low water pressure was 20 psi. Measurements were taken when 100%, 50%, and 5% of product remained in the bags. Data with 100% aspirator engagement was analyzed. An average of approximately 1.46% product remained in the bag when Oasis Lemon Tub and Tile was used, and an average of approximately 1.40% product remained in the bag when water was used. Therefore, substantially all of the product was dispensed from the bag regardless of the type of product.

There was little or no effect on the dispensing rate of the product due to the cabinet orientation, bag orientation, product viscosity, or product supply pressure. There was a large effect on the dispensing rate of the product due to aspirator engagement. Smaller effects were observed due to product fill level in a bag and the bag positions. The rates decreases considerably at 5%, and a lower rate was observed in the bottom cabinet position.

In another embodiment, a disposable liquid containing and dispensing package 200 includes a flexible, collapsible bag 201 and a spout or fitment 216. The bag has a first wall 202 with a perimeter 203 and a second wall 204 with a perimeter 205. The perimeters 203 and 205 are similarly sized and configured, and the first wall 202 and the second wall 204 are operatively connected by seam 206 proximate the perimeters 203 and 205 thereby forming the bag 201. However, it is recognized that the walls 202 and 204 may be connected in various locations not limited to proximate the perimeter by any suitable means well known in the art. When the bag 201 is empty and flattened, the first wall 202 and the second wall 204 are parallel. In the preferred embodiment, the seam 206 is heat sealed to form the bag 201 with a cavity 212 formed therein. A liquid 218 is contained within the cavity 212.

Figure 8:
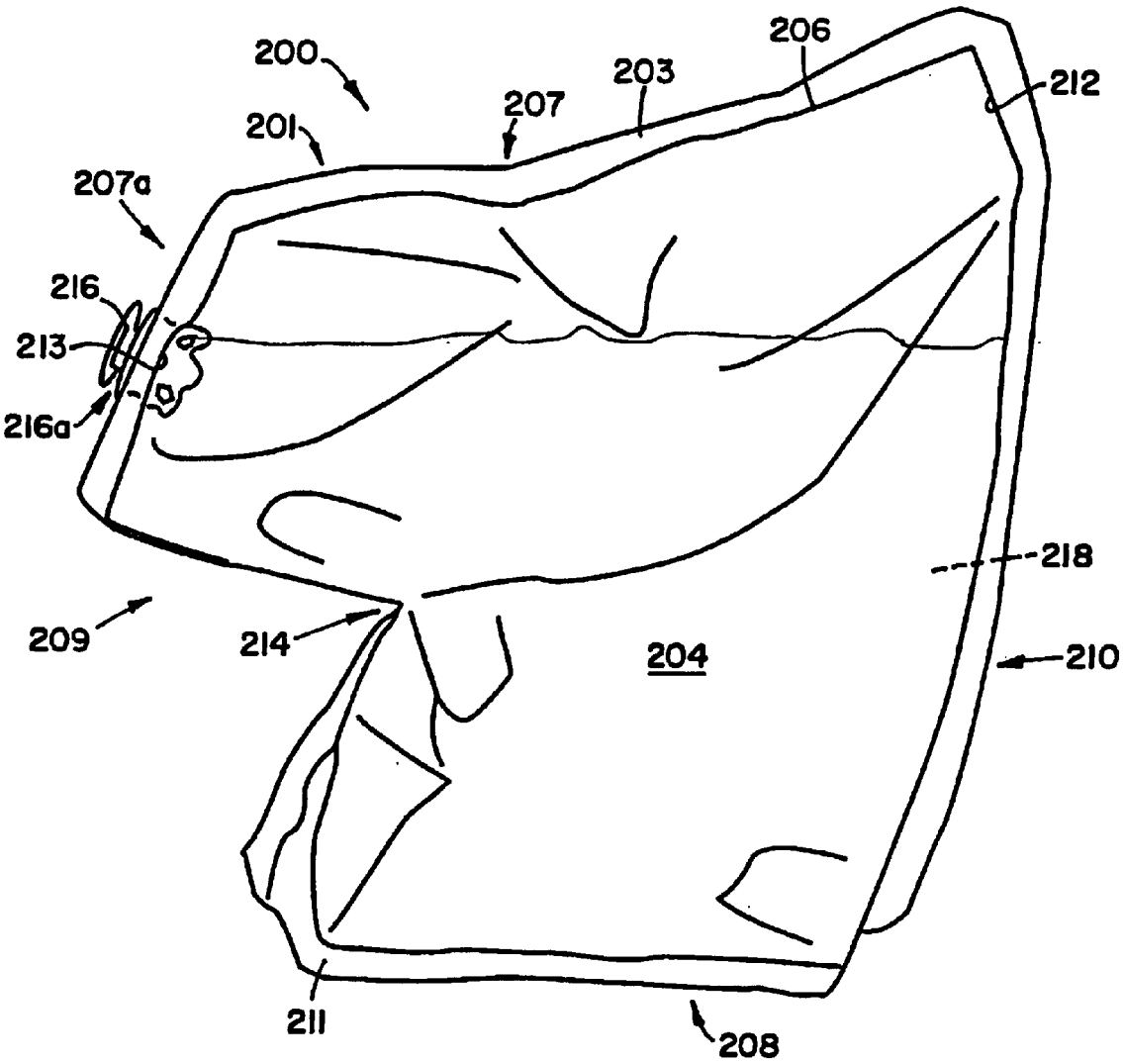
FIG. 8 is a side view of another embodiment disposable liquid containing and dispensing package constructed according to the principles of the present invention.
Figure 9:
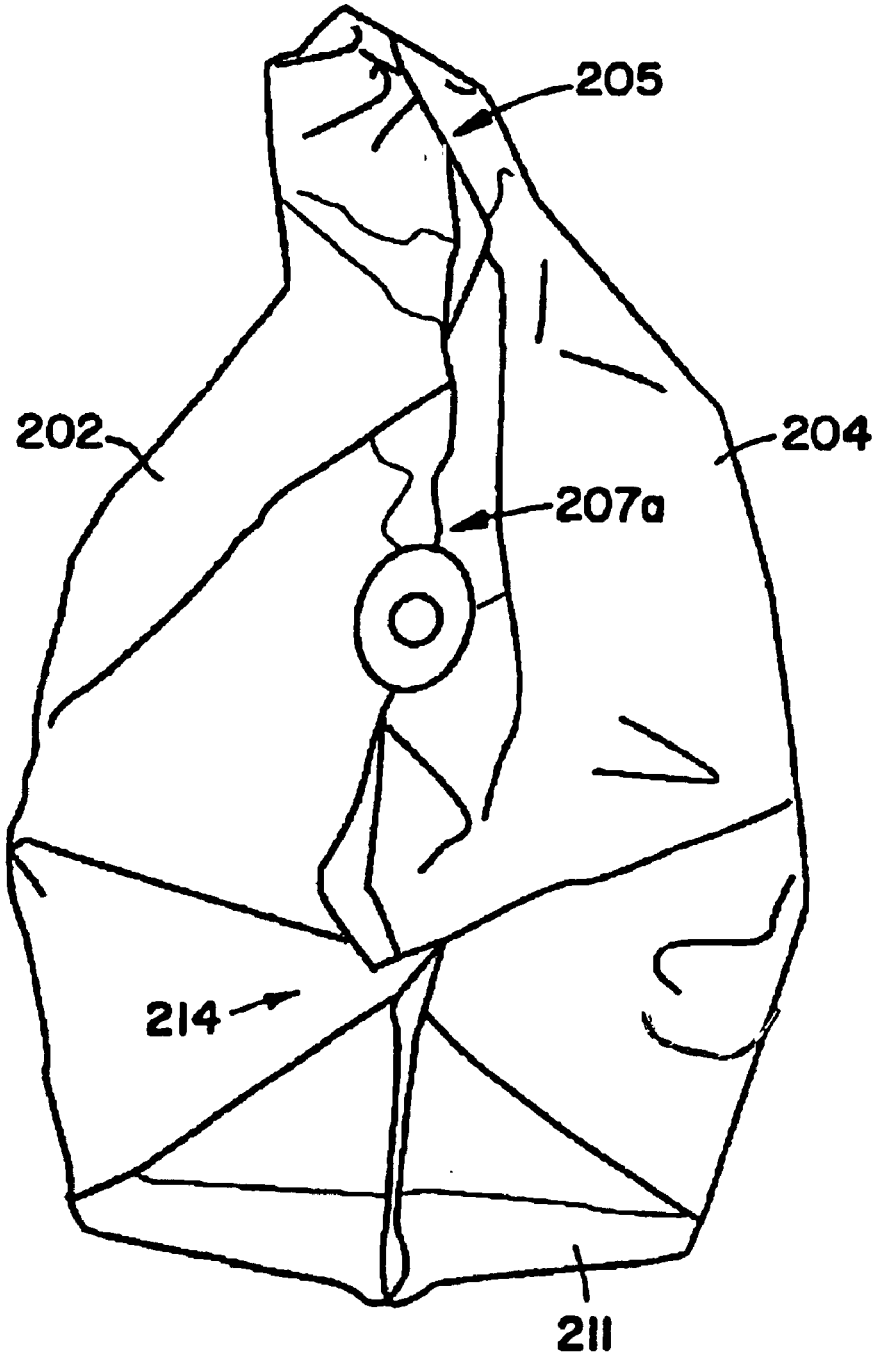
FIG. 9 is a top perspective view of the package shown in FIG. 8.
Figure 12:
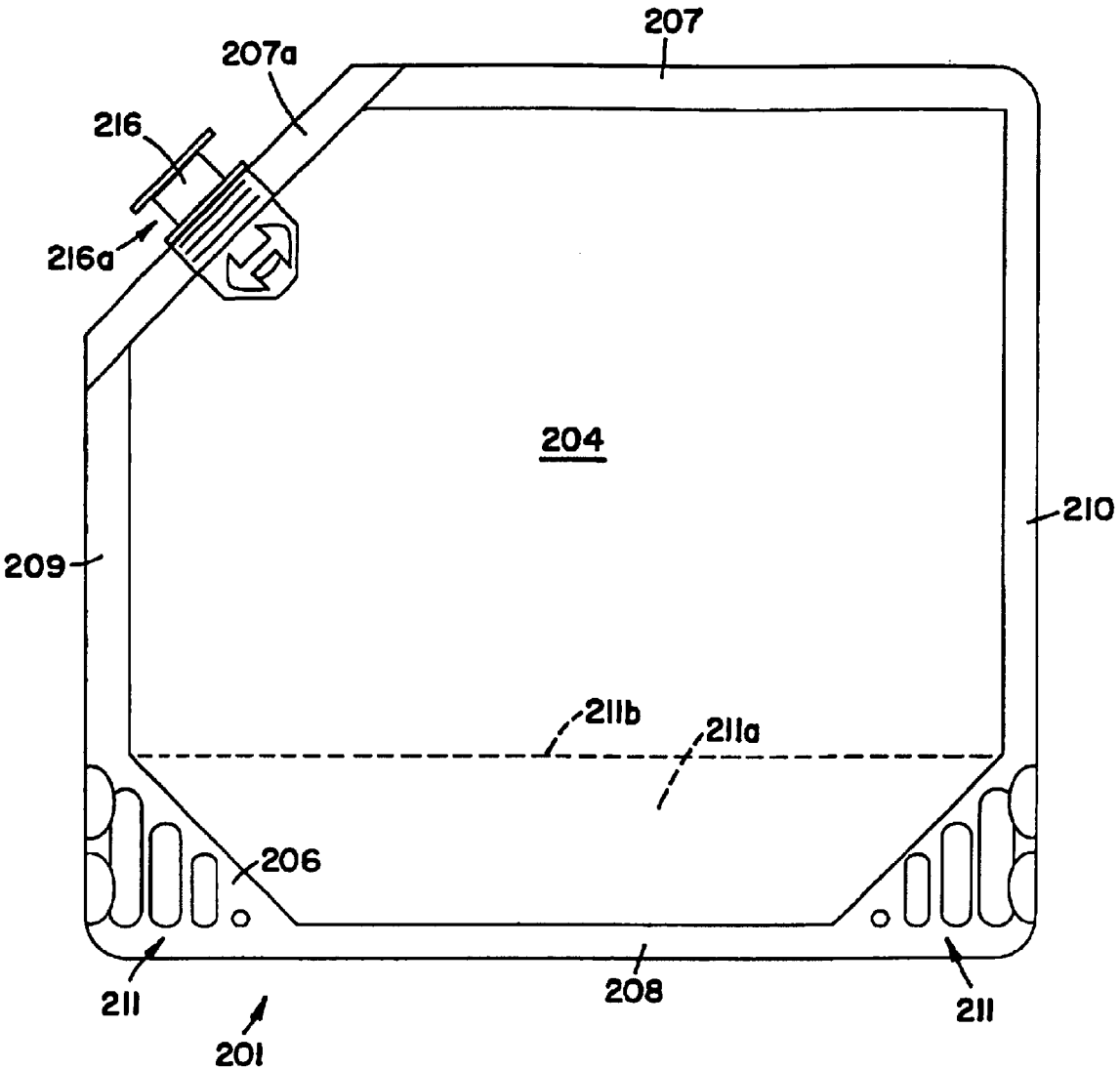
FIG. 12 is a side view of the package shown in FIG. 8.
Figure 16:
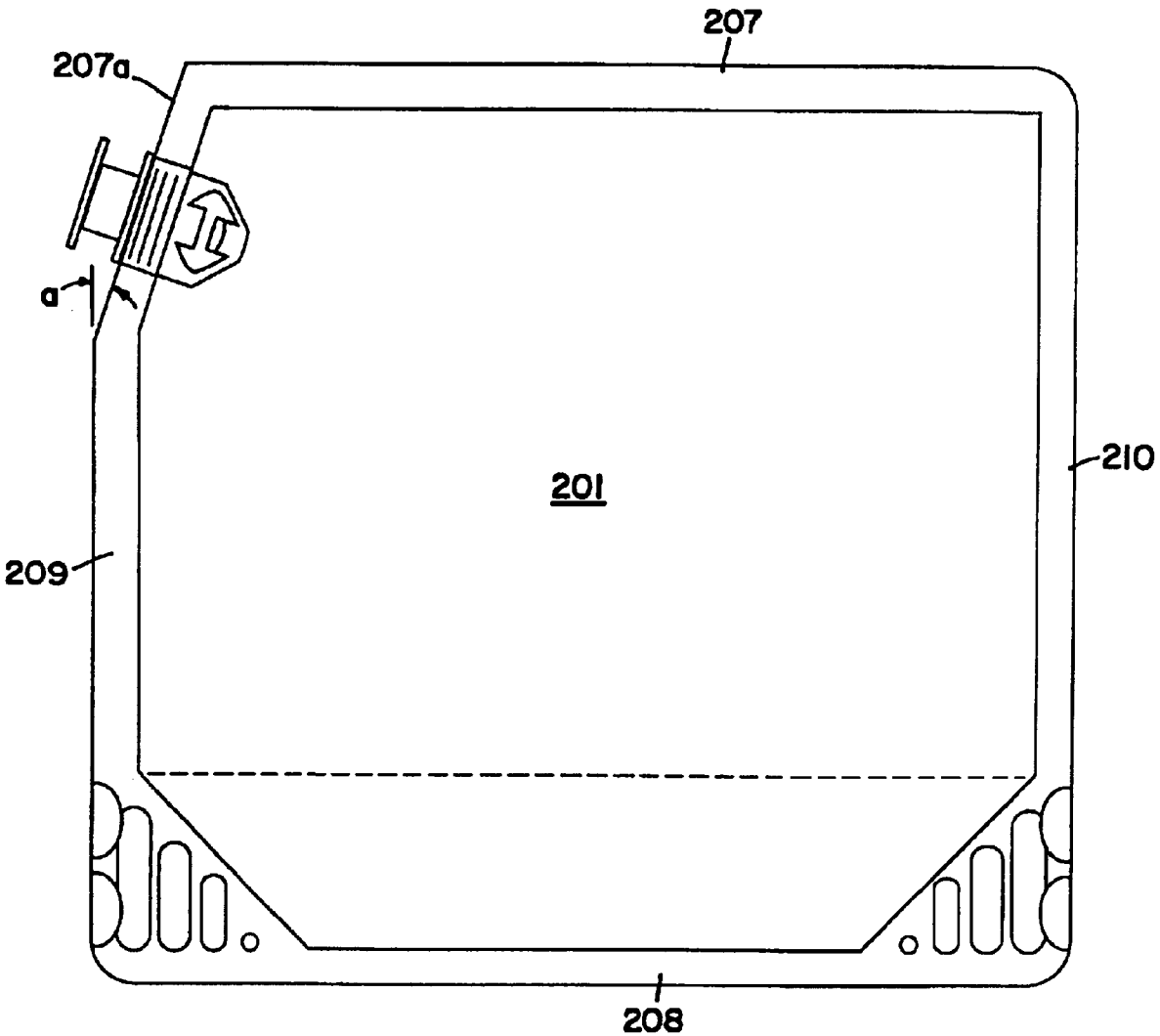
FIG. 16 is a side view of the package of FIG. 12 showing another angled portion at another angle.
Figure 17:
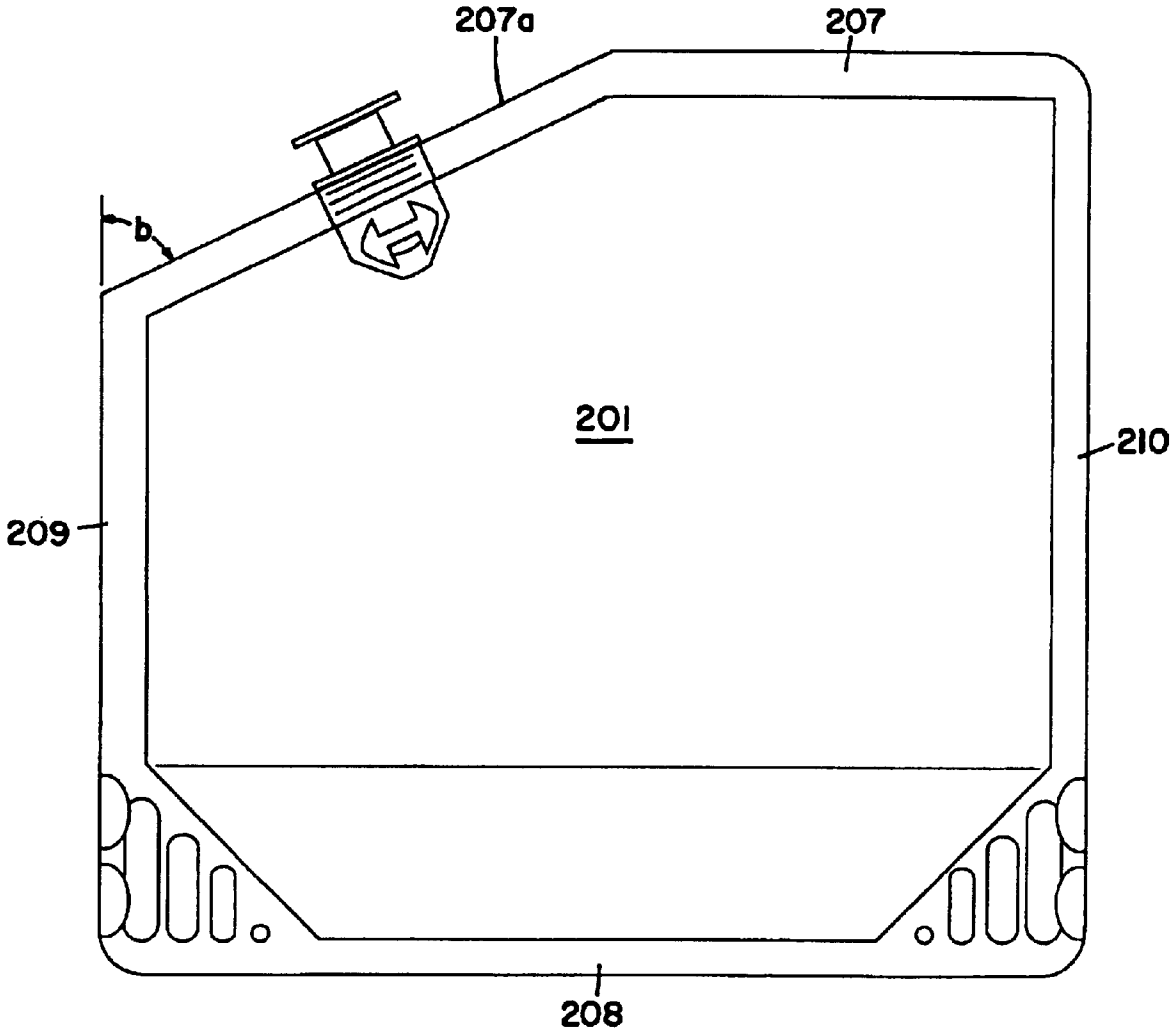
FIG. 17 is a side view of the package of FIG. 12 showing another angled portion at another angle.

The bag 201 is preferably generally slightly rectangular in shape, which is shown in FIG. 12, and contains approximately two liters of liquid. The preferred embodiment bag has dimensions of approximately 9 inches high by 10 inches long. As shown in FIGS. 8 and 9, the bag 201 includes a top 207, a bottom 208, a first side 209, and a second side 210. In the preferred embodiment, an angled portion 207*a* interconnects the top 207 and the first side 209, and an opening 213 is located within the angled portion 207*a* proximate the juncture of the top 207 and the first side 209. The angled portion 207*a* is preferably at an angle of 15–75° from the first side 209, and the preferred embodiment utilizes an angle of approximately 45°. FIG. 16 shows bag 201 having an angled portion 207*a* with an angle "a" approximately 15° from the first side 209, and FIG. 17 shows bag 201 having an angled portion 207*a* with an angle "b" approximately 75° from the first side 209. An opening 213 is located proximate the juncture of the top 207 and the first side 209 and the spout 216 is operatively connected within the opening 213 to the bag 201. The opening 213 allows access into the cavity 212. Although the spout 216 is shown proximate the center of the angled portion 207*a*, the spout 216 may be located anywhere along the angled portion 207*a* as long as there is approximately 10 mm from the end on either side of the angled portion 207*a* to accommodate the seam 206. Although the opening 213 and the spout 216 may be positioned and oriented in numerous arrangements on the bag 201, it is preferred they be located above the liquid level line and proximate the indentation 214 or 215. The spout 216includes a groove 216*a*, which is configured and arranged to accept a collar member of a dispenser housing to assist in keeping the spout 216 positioned properly.

The bottom 208 includes a stabilizing member 211, which is also a gusseted portion of the bag 201 to assist in providing support when placed in a vertical position. To create the gusseted portion, a third sheet 211*a* is folded in half to form a fold 211*b* and placed between the first wall 202 and the second wall 204 proximate the bottom 208. Along the bottom 208, a first end of the third sheet 211*a* is connected to the first wall 202 and a second end of the third sheet 211*a* is connected to the second wall 204 by seam 206. In other words, the bag 201 is bifurcated from the fold 211*b* to the perimeter 203 of the bottom 208. The sides of the third sheet 211*a* are connected to both the first wall 202 and the second wall 204. In other words, the first side 209 and the second side 210 have four layers along the third sheet 211*a*. As shown in FIG. 12, the seam 106 cuts generally diagonally proximate the juncture of the first side 209 and the bottom 208 and the juncture of the second side 210 and the bottom 108. When the bag 201 is filled with liquid 218 and placed on its bottom 208, the liquid 218 pushes the first and second walls 202 and 204 apart thereby opening the third sheet 211*a* and providing a surface upon which the bag 201 may be supported.

The bag 201 may be placed in two different orientations to create an indentation 214 or 215. The orientation of the bag 201 does not create a passageway for the liquid 218 as a dip strip or dip tube does, however, it prevents flush contact between the two walls 202 and 204 of the bag 201 that would seal off the bag 201. In other words, the indentation 214 or 215 prevents flush contact between the walls 202 and 204 thereby allowing most of the liquid 218 to flow out of the bag 201 without interference from the bag 201. Again, the first indentation 214 and the second indentation 215 are sufficiently rigid horizontal members extending from the first wall 202 and the second wall 204 to keep the walls spaced apart from each other while the package is being emptied. The sufficiently rigid horizontal members may be creases or pleats formed in the walls to keep the walls apart from one another, and the shape of the bag along with the liquid contained within the bag assist in keeping the creases or pleats in the walls. Alternatively, reinforced portions or heat sealed portions extending from the first wall 202 and the second wall 204 proximate the angled portion 207*a* may be included to assist in keeping the first and second walls apart. The reinforced portions or heat sealed portions may be included on the first side 209 or on the top 207 as well.

Figure 10:
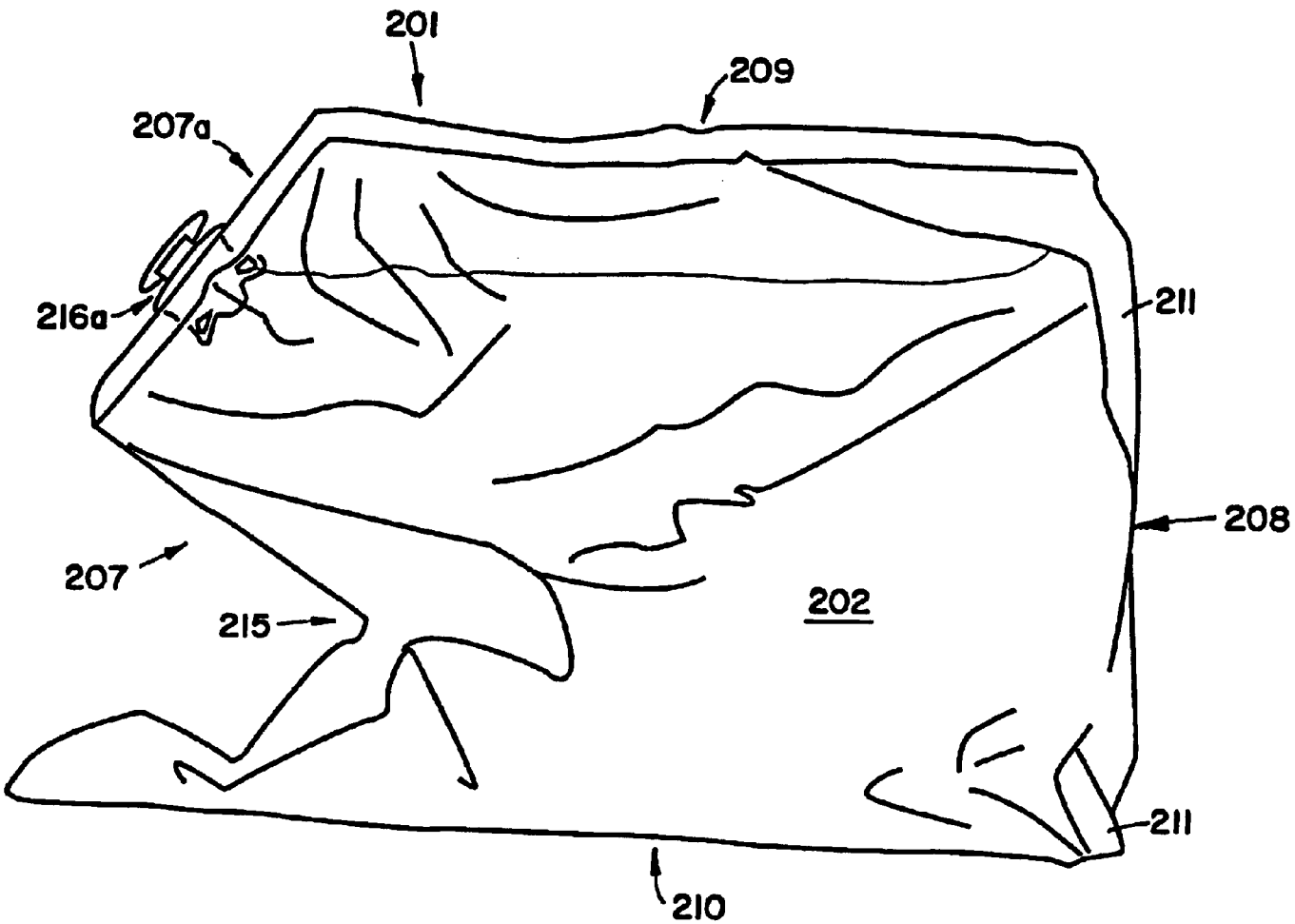
FIG. 10 is a side view of the package shown in FIG. 8 in another orientation.
Figure 11:
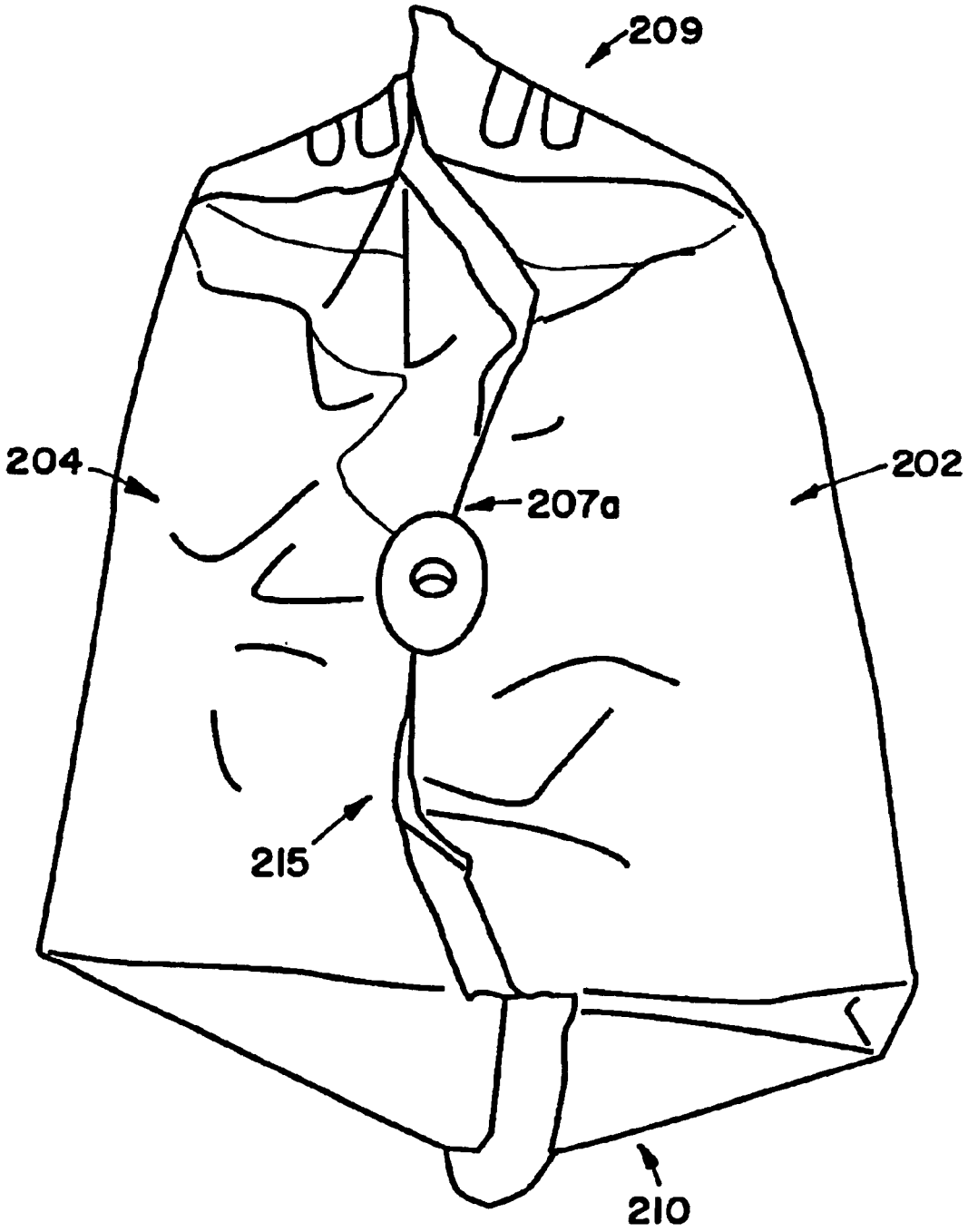
FIG. 11 is a top perspective view of the package shown in FIG. 10.

The preferred orientation of the bag 201 is in a vertical position resting on the stabilizing member 211 on the bottom 208, as shown in FIGS. 8 and 9. When placed in a vertical orientation, the first side 209 of the bag 201 includes a first indentation 214, which prevents flush contact between the walls 202 and 204 of the bag 201. In an alternate position, shown in FIGS. 10 and 11, the bag 201 rests on the second side 210 and the top 207 of the bag 201 includes a second indentation 215, which prevents flush contact between the walls 202 and 204 of the bag 201. When the bag 201 is placed in a horizontal orientation, the bag 201 rests on the second side 210 and the stabilizing member 211 is located on the side of the bag 201 generally opposite the spout 216.

Figure 18:
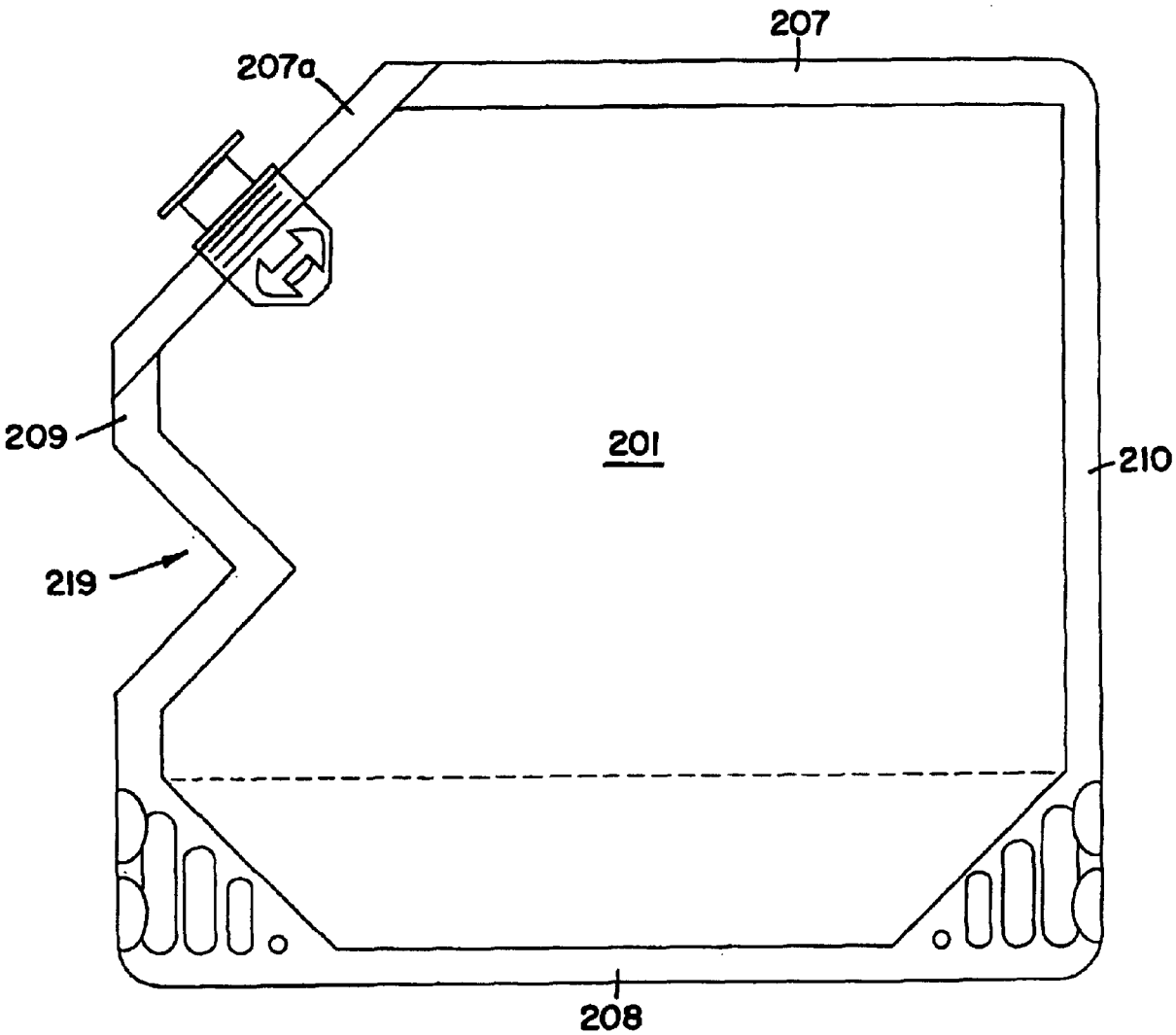
FIG. 18 is a side view of the package of FIG. 12 showing a notch in a first side of the package.

The bag 201 may or may not naturally form the indentations 214 and 215. Therefore, it may be necessary to include means for creating and reinforcing the indentation 214 or 215 in the bag 201. As shown in FIG. 18, a notch 219 may be formed in the first side 209 of the bag 201 to assist in creating an indentation. Although the notch 219 is wedge-shaped, it is recognized that it may also be square-shaped, U-shaped, or any other suitable shape. The notch 219 assists in creating an indentation because when the bag 201 is filled with liquid 218, the notch 219 assists in pulling the first side 209 inward as the side walls 202 and 204 push away from one another.

Figure 13:
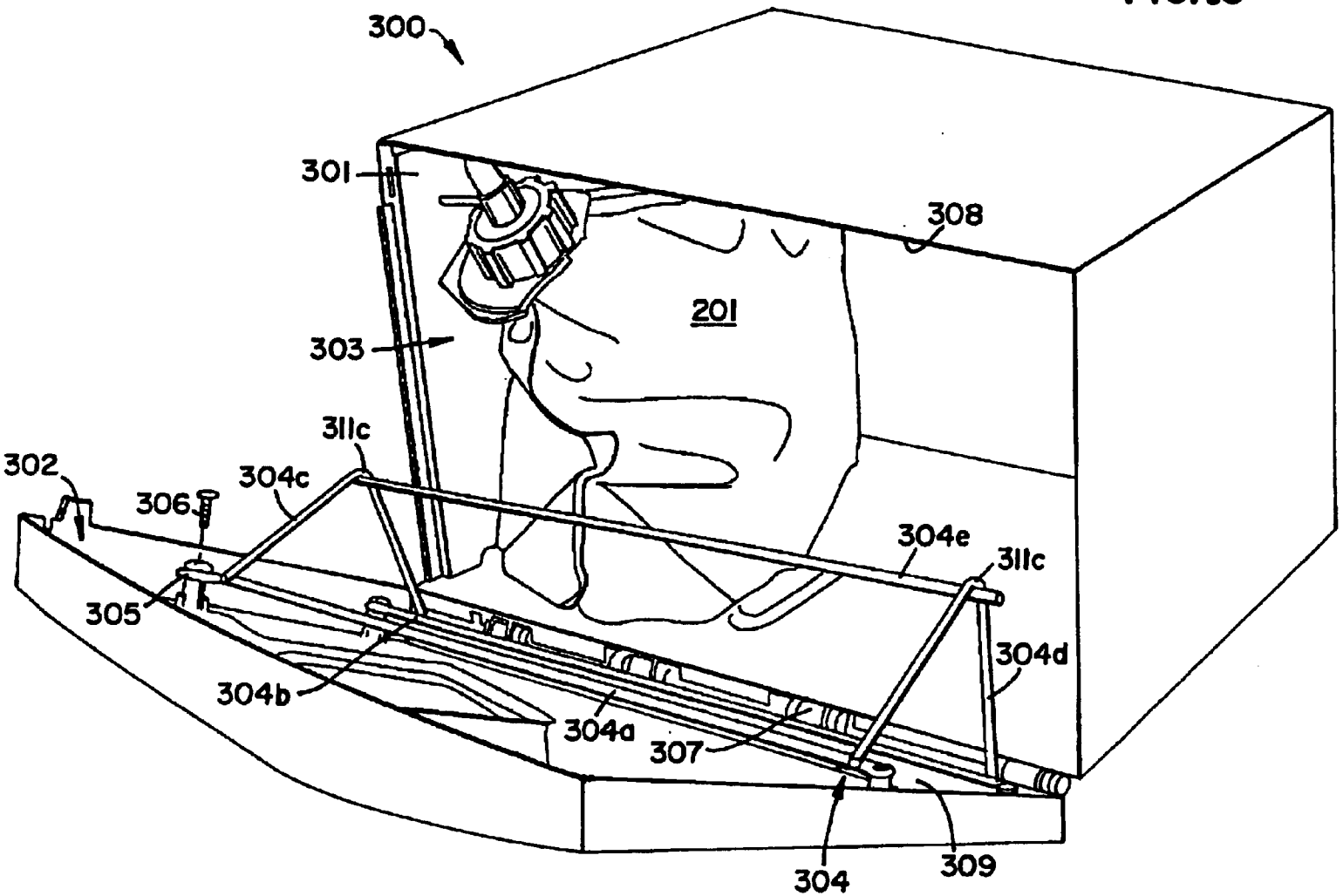
FIG. 13 is a perspective view showing the package of FIGS. 8 and 9 in a housing for use with a dispenser.
Figure 14:
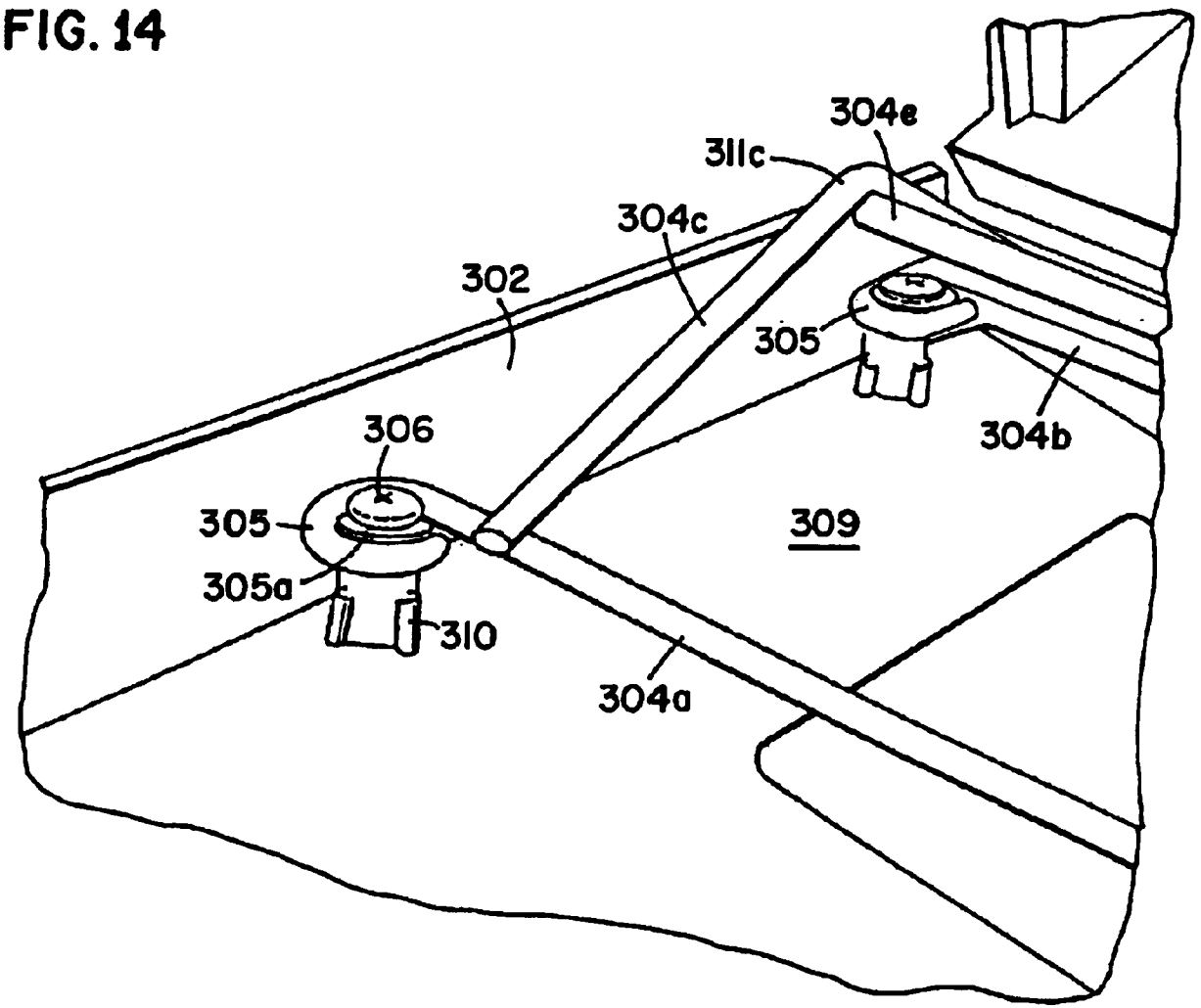
FIG. 14 is a partial view of a door of the housing shown in FIG. 13.

Alternatively, housing 300 for use with a product dispenser, shown in FIGS. 13 and 14, may be used to create and reinforce the indentation. The preferred embodiment housing 300 includes a compartment 301. The compartment 301 is a five-sided box having a cavity 303, which is configured and arranged to receive the bag 201. The sixth side of the compartment 301 is open and includes opening 308. A door 302 is configured and arranged to cover the opening 308 of the compartment 301, and the door 302 is operatively connected to the compartment 301 on one side by a hinge 307. The hinge 307 allows the door 302 to pivot therefrom to open and close the compartment 301.

The door 302 includes an inner surface 309 that faces the cavity 303 of the compartment 301. The inner surface 309 includes attachment members 310 extending outward therefrom, and the attachment members 310 are cylindrical in shape with threaded bores. Preferably, there are four attachment members 310 proximate the edge of the door 302, two near the middle and two near the bottom of the door 302. A bar member 304 is operatively connected to the attachment members 310 and extends outward within and into the cavity 303.

The preferred embodiment bar member 304 is made of metal and includes a first rod 304*a*, a second rod 304*b*, a first extension rod 304*c*, a second extension rod 304*d*, and an indentation rod 304*e*. The first rod 304*a*, the second rod 304*b*, and the indentation rod 304*e* are relatively straight. Each rod 304*a* and 304*b* includes a connector 305 at each end, and the connectors 305 are looped portions at the ends of the rods 304*a* and 304*b* having openings 305*a*. The first rod 304*a* extends between the attachment members 310 near the middle of the door 302, and a fastener 306, such as a screw, is placed through each of the openings 305*a* of the connectors 305. Although a screw is shown in the drawings, any suitable fastener known in the art may be used. Similarly, the second rod 305*b* extends between the attachment members 310 near the bottom of the door 302, and a fastener 306, such as a screw, is placed through each of the openings 305*a* of the connectors 305. The first extension rod 304*c* and the second extension rod 304*d* are rods that are bent approximately 90° to interconnect the first and second rods 304*a* and 304*b* at each end proximate the connectors 305. The elbow portions 311*c* and 311*d* of the first and second extension rods 304*c* and 304*d*, respectively, extend outwardly away from the inner surface 309 of the door 302. The indentation rod 304*e* extends from each elbow portion 311*c* and 311*d*, parallel to the first and second rods 304*a* and 304*b*. As in the preferred embodiment, the bar member may be a separate piece operatively connected to the door or it may be one solid piece integral with the door. For example, the bar member could be molded as part of the door such as a ledge extending from the door.

When the bag 201 is contained within the housing 300, the bar member 304 contacts either the first side 209 or the top 207 to create the indentation 214 or 215, respectively. Because the bar member 304 protrudes into the cavity 303, the bar member 304 assists in creating and/or maintaining the indentation of the bag 201, and the bar member 304 reinforces the indentation of the bag 201. The preferred embodiment bar member 304 contacts the bag 201 proximate the middle two thirds of the height of the initial liquid level and extends approximately one to three inches into the bag to create an indentation. In a bag filled with liquid having a center width of approximately four to six inches, the indentation is approximately 50 to 125% of the width of the bag.

Figure 15:
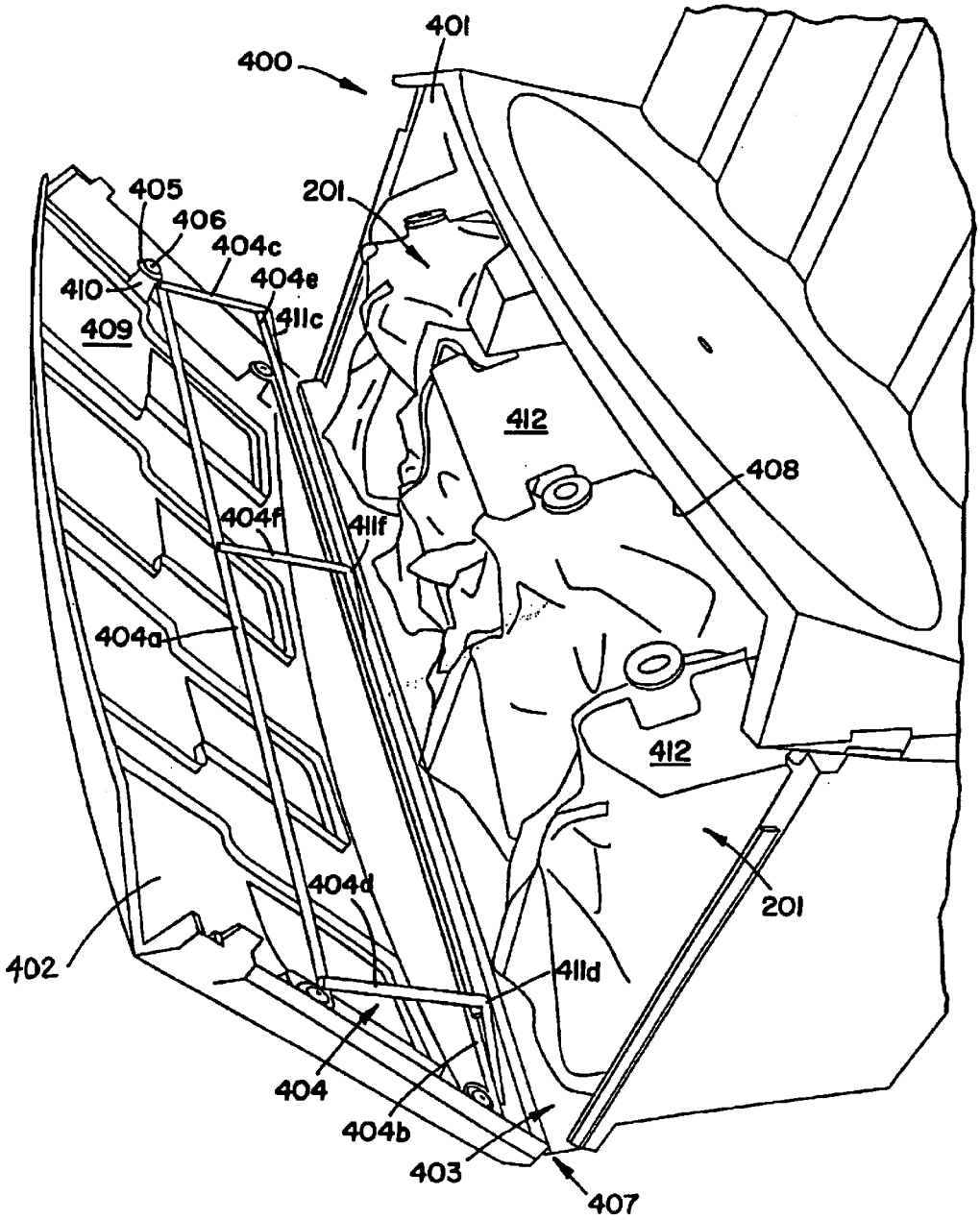
FIG. 15 is a perspective view showing four packages of FIG. 8 in another embodiment housing for use with a dispenser.

The preferred embodiment housing 300 is configured and arranged to contain one flexible bag 201, however, it is recognized that the housing may contain a plurality of flexible bags. In addition, the housing 300 includes at least one compartment 301, but any number of compartments may be used. For example, the housing 400 shown in FIG. 15 includes dividers (not shown) defining multiple compartments. Similarly, the bar member may be a single bar structure or it may include a plurality of bar structures to accommodate the number of compartments of the housing.

Housing 400 includes a compartment 401, which is a five-sided box having a cavity 403. Within the cavity 403, there are three dividers (not shown) that separate the compartment 401 into four sub-compartments. Each sub-compartment is configured and arranged to receive a bag 201. The sixth side of the compartment 401 is open and includes opening 408. A door 402 is configured and arranged to cover the opening 408 of the compartment 401, and the door 402 is operatively connected to the compartment 401 on one side by a hinge 407. The hinge 407 allows the door 402 to pivot therefrom to open and close the compartment 401.

The door 402 includes an inner surface 409 that faces the cavity 403 of the compartment 401. The inner surface 409 includes attachment members 410 extending outward therefrom, and the attachment members 410 are cylindrical in shape with threaded bores. Preferably, there are four attachment members 410 proximate the edge of the door 402, two near the middle and two near the bottom of the door 402. A bar member 404 is operatively connected to the attachment members 310 and extends outward into the cavity 403.

The preferred embodiment bar member 404 is made of metal and includes a first rod 404*a*, a second rod 404*b*, a first extension rod 404*c*, a second extension rod 404*d*, an indentation rod 404*e*, and a third extension rod 404*f*. The first rod 404*a*, the second rod 404*b*, and the indentation rod 404*e* are relatively straight. Each rod 404*a* and 404*b* includes a connector 405 at each end, and the connectors 405 are looped portions at the ends of the rods 404*a* and 404*b* having openings (not shown). The first rod 404*a* extends between the attachment members 410 near the middle of the door 402, and a fastener 406, such as a screw, is placed through each of the openings of the connectors 405. Although a screw is shown in the drawings, any suitable fastener known in the art may be used. Similarly, the second rod 405*b* extends between the attachment members 410 near the bottom of the door 402, and a fastener 406, such as a screw, is placed through each of the openings of the connectors 405. The first extension rod 404*c*, the second extension rod 404*d*, and the third extension rod 404*f* are rods that are bent approximately 90° to interconnect the first and second rods 404*a* and 404*b*. The elbow portions 411*c*, 411*d*, and 411*f* of the rods 404*c*, 404*d*, and 404*f*, respectively, extend outwardly away from the inner surface 409 of the door 402. The first and second extension rods 404*c* and 404*d* are operatively connected to each rod 404*a* and 404*b* at each end proximate the connectors 305. The third extension rod 404*f* is operatively connected to each rod 404*a* and 404*b* proximate the center of the rods. The indentation rod 304*e* extends from each elbow portion 411*c*, 411*d*, and 411*f* parallel to the first and second rods 304*a* and 304*b*. As in the preferred embodiment, the bar member may be a separate piece operatively connected to the door or it may be one solid piece integral with the door. For example, the bar member could be molded as part of the door such as a ledge extending from the door. In addition, housing 400 includes collar members 412. Collar members 412 are positioned proximate the top of the housing 400 and are configured and arranged to slide into the grooves 216*a* of spouts 216. The collar members 412 assist in keeping the spout 216 positioned properly within the compartment 401.

When the bag 201 is contained within the housing 400, the bar member 404 contacts either the first side 209 or the top 207 to create the indentation 214 or 215, respectively. Because the bar member 404 protrudes into the cavity 403, the bar member 404 assists in creating and/or maintaining the indentation of the bag 201, and the bar member 404 reinforces the indentation of the bag 201. The preferred embodiment bar member 404 contacts the bag 201 proximate the middle two thirds of the height of the initial liquid level and extends approximately one to three inches into the bag to create an indentation. In a bag filled with liquid having a center width of approximately four to six inches, the indentation is approximately 50 to 125% of the width of the bag.

The preferred embodiment bag is made of 0.004 to 0.007 inch film and contains two liters of liquid. The seam is approximately 5 to 10 mm wide. The liquid containment area of the bag has a center width range of approximately four to six inches, and the length to height ratio of the preferred embodiment bag within this width range is approximately 1:1 to 3:1. Although a two-liter bag is preferred, it is recognized that other suitable sizes are acceptable as long as the ratio of the length to the height with regard to the width of the bag are proportionately consistent with those disclosed herein.

The present invention is designed to dispense product(s) from a bag using traditional aspirating technology. The bag is a uniquely designed pouch using a lock and key fitment attached to the bag and a docking probe mechanism as part of the dispensing system. The bag will include the fitment while the dispenser housing includes a compartment for the bag and a docking mechanism to open the bag to the aspirator. The dispenser housing could also include a cover with a locking door to protect the product and the aspirating equipment. The dispenser housing could accommodate one to four docking sites for product bags. The fitment requires a probe to open the fitment. The docking mechanism incorporates the probe into conventional action similar to tightening a cap on a bottle. After the probe pierces the fitment, the probe can be withdrawn. The fitment will then reseal and the bag will close thereby reducing spillage of product from the bag.

The bag allows the product to completely drain from the bag with the spout or fitment in an upright position. Evacuation tests show repeated drainage of at least 95% of the product in the bag. In addition to the spout or fitment designed to reduce spillage, the spout or fitment being placed proximate the top of the bag also minimizes the risk of spillage or leaking of the product.

Although flexible, collapsible bags such as this are commonly used with post-mix beverage dispensers, it is envisioned that the present invention could also be used for various types of institutional cleaning chemistries including laundry, housekeeping, warewashing, and vehicle care. The present invention may be used for small package sizes, locking cabinets, and multi-product dispensing systems.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A disposable liquid containing and dispensing package, comprising:

a) a flexible bag including a first wall, a second wall, and a cavity, said first wall and said second wall being operatively connected thereby creating a seam and creating said cavity therein, said bag including a top, a bottom, a first side, and a second side;

b) an opening in said bag proximate said top and said first side of said bag, said opening allowing access to said cavity;

c) a spout operatively connected to said opening;

d) a liquid contained within said cavity; and e) an indentation in said seam on said first side of said bag, said indentation formed when said bag is positioned along said seam on said bottom, said indentation hindering flush contact between said first wall and said second wall as said bag progressively collapses as said liquid is dispensed.

2. The package of claim 1, further comprising a plurality of protrusions formed on at least one wall of said bag, said plurality of protrusions extending from proximate said second side to proximate said spout, wherein said plurality of protrusions hinders flush contact between said first wall and said second wall as said bag progressively collapses as the liquid is dispensed.

3. The package of claim 2, wherein said plurality of protrusions is embossed on said at least one wall of said bag.

4. The package of claim 1, wherein said indentation is a sufficiently rigid horizontal member extending from said first wall and said second wall to keep the walls spaced apart from each other while the package is being emptied.

5. The package of claim 1, further comprising a dispenser housing having a door and a bar member operatively connected to the door, the dispenser housing being configured and arranged to receive the bag, wherein the bar member on the door creates and reinforces the indentation of the bag.

6. The package of claim 1, wherein said bag contains approximately two liters of liquid, said bag containing liquid having a liquid containment area with a width proximate a middle portion of said liquid containment area of approximately 4 to 6 inches and with a length to height ratio of approximately 1:1 to 3:1.

7. The package of claim 1, wherein said bag is made of 0.004 to 0.007 inch film and said seam is approximately 5 to 10 mm wide.

8. The package of claim 1, further comprising a stabilizing member to provide support for said bag when said bag is placed in a vertical orientation.

9. A method of dispensing a liquid from a collapsible, disposable bag within a dispenser housing, the bag being made of 0.004 to 0.007 inch film, the bag including a first wall and a second wall, the first wall and the second wall being sealed along a seam, the seam being approximately 5 to 10 mm wide, the bag including a top, a bottom, a first side, and a second side, the seam forming a cavity and including an opening proximate the top and the first side of the bag, a spout operatively connected within the opening to provide access to the cavity, approximately two liters of liquid contained within the cavity, wherein a liquid containment area of the bag has a middle portion with a width of approximately 4 to 6 inches and a length to height ratio of approximately 1:1 to 3:1, comprising:

a) placing a bag filled with liquid in a dispenser housing on a bottom seam of the bag;

b) forming a first indentation in a seam on a first side of the bag, the indentation extending from the first wall to the second wall; and c) dispensing the liquid from the bag, wherein the first indentation hinders flush contact between the first wall and the second wall as the bag progressively collapses as the liquid is dispensed.

10. The method of claim 9, further comprising forming a second indentation on the top of the bag, wherein the second indentation hinders flush contact between the first wall and the second wall as the bag progressively collapses as the liquid is dispensed.

11. The method of claim 9, the dispenser housing having a door and a bar member operatively connected to the door, further comprising orienting the bag within the dispenser housing whereby the bar member creates and reinforces the first indentation.

12. A method of dispensing a liquid from a bag, comprising:

a) providing a first wall and a second wall, said walls being made of 0.004 to 0.007 inch film;

b) creating a textured surface on at least one of said walls;

c) sealing said first wall and said second wall together thereby forming a bag with a cavity and an opening, said bag having a top, a bottom, a first side, and a second side, said opening being proximate said top and said first side allowing access to said cavity, said textured surface extending from proximate said second side to proximate said opening;

d) providing a spout and operatively connecting said spout within said opening of said bag;

e) filling the cavity of the bag with a liquid, the bag filled with liquid having a liquid containment area with a length to height ratio of approximately 1:1 to 3:1;

f) placing the bag filled with the liquid in a dispenser housing on the bottom of the bag;

g) creating an indentation on said first side of said bag; and h) dispensing the liquid from the spout, wherein said indentation and said plurality of protrusions hinder flush contact between said first wall and said second wall as said bag progressively collapses.

13. The method of claim 12, said bag containing approximately two liters of liquid and said liquid containment area having a middle portion with a width of approximately 4 to 6 inches.

14. The method of claim 12, further comprising creating a second indentation on said top of said bag, wherein said second indentation hinders flush contact between said first wall and said second wall as said bag progressively collapses.

15. A dispensing system, comprising:

a) a housing for use with a product dispenser, said housing including a compartment and a door, said compartment having a first cavity and an opening allowing access to said first cavity, said door being configured and arranged to cover said opening and having an inner surface;

b) a flexible bag including a first wall, a second wall, and a second cavity, said first wall and said second wall being operatively connected thereby creating a seam and creating said second cavity therein, said bag including a top, a bottom, a first side, and a second side, said bag including an opening proximate said top and said first side of said bag, said opening allowing access to said second cavity;

c) a spout operatively connected to said opening;

d) a liquid contained within said second cavity;

e) an indentation in said seam on said first side of said bag, said indentation formed when said bag is positioned along said seam on said bottom, said indentation hindering flush contact between said first wall and said second wall as said bag progressively collapses as the liquid is dispensed; and f) a bar member operatively connected to and extending from said inner surface of said door, said bar member creating and reinforcing said indentation in said bag when said bag is placed within said first cavity.

16. The dispensing system of claim 15, wherein said housing is configured and arranged to contain one flexible bag.

17. The dispensing system of claim 15, wherein said housing is configured and arranged to contain a plurality of flexible bags.

18. The dispensing system of claim 17, wherein said bar member includes a plurality of bars corresponding with the plurality of flexible bags.

19. A disposable liquid containing and dispensing package, comprising:

a) a flexible bag including a first wall, a second wall, and a cavity, said first wall and said second wall being operatively connected thereby creating a seam and creating said cavity therein, said bag including a top, a bottom, a first side, and a second side;

b) an opening in said bag proximate said top and said first side of said bag, said opening allowing access to said cavity;

c) a spout operatively connected to said opening;

d) a liquid contained within said cavity; and e) an indentation on said first side of said bag, said indentation being a sufficiently rigid horizontal member extending from said first wall and said second wall to keep the walls spaced apart from each other, said indentation being formed when said bag is positioned along said bottom, said indentation hindering flush contact between said first wall and said second wall as said bag progressively collapses as the liquid is dispensed.

20. The package of claim 19, wherein said bag contains approximately two liters of liquid, said bag containing liquid having a liquid containment area with a width proximate a middle portion of said liquid containment area of approximately 4 to 6 inches and with a length to height ratio of approximately 1:1 to 3:1.

21. The package of claim 19, wherein said bag is made of 0.004 to 0.007 inch film and said seam is approximately 5 to 10 mm wide.

22. The package of claim 19, wherein said indentation is formed naturally when said bag is filled with liquid and said bag is positioned along said bottom.

23. The package of claim 19, wherein said indentation is a reinforced portion on said bag extending from said first wall to said second wall.

24. The package of claim 19, wherein said indentation is formed by a bar member, said bar member creating and reinforcing said indentation.

* * * * *